US009929456B2

(12) United States Patent
Mei

(10) Patent No.: US 9,929,456 B2
(45) Date of Patent: Mar. 27, 2018

(54) RF TERMINATION

(71) Applicant: ANAREN, INC., East Syracuse, NY (US)

(72) Inventor: Chong Mei, Jamesville, NY (US)

(73) Assignee: ANAREN, INC., East Syracuse, NY (US)

( * ) Notice: Subject to any disclaimer, the term of this patent is extended or adjusted under 35 U.S.C. 154(b) by 121 days.

(21) Appl. No.: 15/062,362

(22) Filed: Mar. 7, 2016

(65) Prior Publication Data

US 2017/0256835 A1 Sep. 7, 2017

(51) Int. Cl.

| | |
|---|---|
| ***H01P 5/12*** | (2006.01) |
| ***H01P 1/24*** | (2006.01) |
| ***H01P 3/08*** | (2006.01) |

(52) U.S. Cl.

CPC ..... *H01P 1/24* (2013.01); *H01P 3/081* (2013.01); *H01P 5/12* (2013.01)

(58) Field of Classification Search

CPC ..... H01P 1/24; H01P 3/081; H01P 5/12

USPC ..... 333/137

See application file for complete search history.

(56) References Cited

U.S. PATENT DOCUMENTS

| | | | | |
|---|---|---|---|---|
| 4,356,462 A * | 10/1982 | Bowman | H01P 5/12 | 333/128 |
| 6,320,478 B1 * | 11/2001 | Sims, III | H01P 5/12 | 333/127 |
| 6,538,528 B2 * | 3/2003 | Louzir | H01P 1/184 | 333/128 |
| 8,284,106 B2 * | 10/2012 | Guan | H01Q 1/36 | 343/700 MS |
| 8,358,181 B2 * | 1/2013 | Shimamura | H01P 1/22 | 333/81 A |

* cited by examiner

*Primary Examiner* — Robert J Pascal
*Assistant Examiner* — Kimberly Glenn
(74) *Attorney, Agent, or Firm* — Bond Schoeneck & King, PLLC; George McGuire; David Nocilly

(57) ABSTRACT

The present invention is directed to an RF termination device that includes a substrate having a first meandered transmission line disposed on a first surface thereof. The meandered first transmission line has a predetermined first transmission line length and a characteristic impedance substantially equal to twice the predetermined system impedance. One end of the first meandered transmission line is configured as an open circuit. A second meandered transmission line is disposed on the first major surface adjacent the first meandered transmission line. The meandered second transmission line has a predetermined second transmission line length and a characteristic impedance substantially equal to twice the predetermined system impedance. One end of the second meandered transmission line is coupled to the other end of the first transmission line and the other end is coupled to ground.

24 Claims, 3 Drawing Sheets

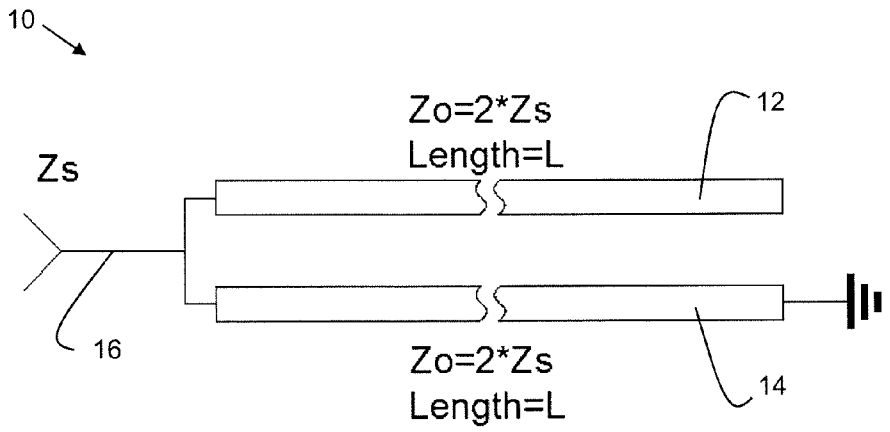
FIG. 4
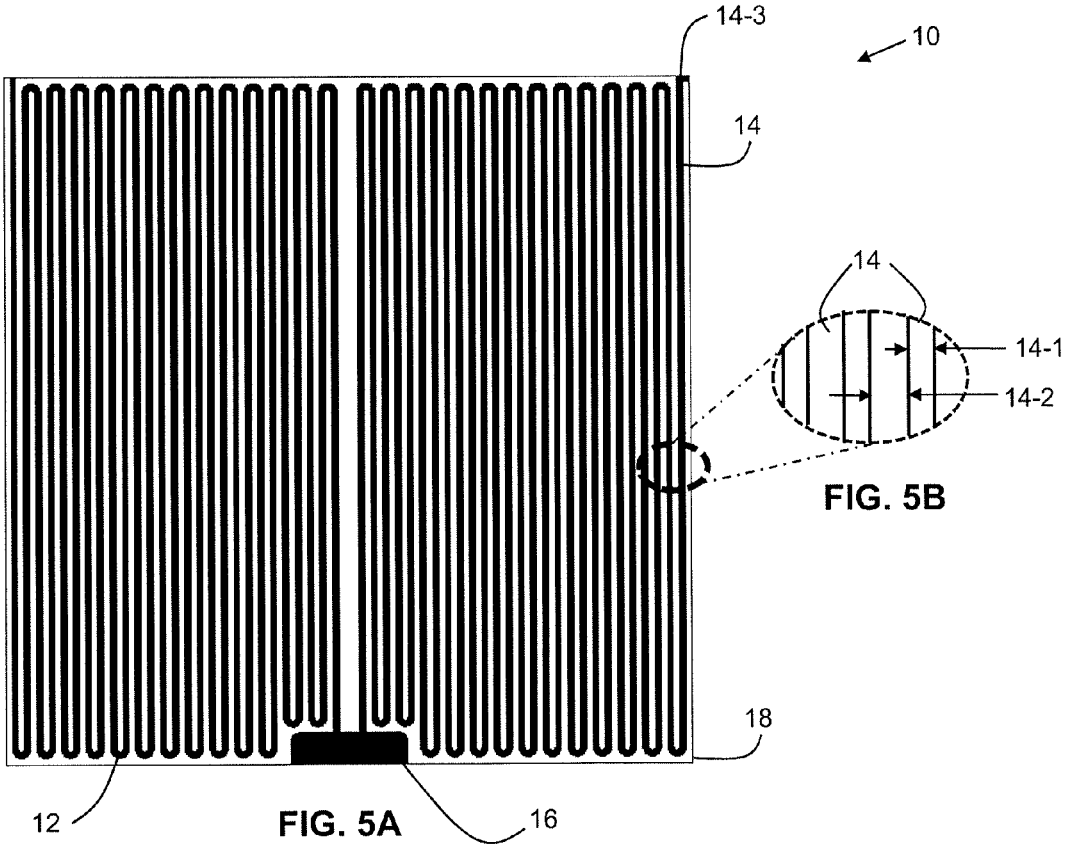
FIG. 5B
FIG. 5A

RF TERMINATION

BACKGROUND OF THE INVENTION

1. Field of the Invention

The present invention relates generally to RF transmission lines, and particularly to REF terminations for said RF transmission lines.

2. Technical Background

In reference to FIG. 1, a block diagram of an RF device 1 connected to termination impedance 3 is shown. The termination impedance 3 is employed to prevent an RF signal from being reflected (from the end of the transmission line) back into device 1. As those of ordinary skill in the art will appreciate, signal reflection occurs when a signal propagates down a transmission line and encounters an impedance mismatch. (The amount of reflected energy depends on the impedance mismatch). When signals are reflected back into the device 1, the 1device performance can be degraded, and worse yet, the device itself can be damaged.

By way of another example, FIG. 2 is a diagrammatic depiction of an RF directional coupler 1' that is often employed in RF applications. The directional coupler 1' includes a first transmission line 5-1 disposed in parallel with a second transmission line 5-2. The coupler 1' may be configured as, e.g., a quarter wavelength ($\lambda/4$) coupler. The first transmission line 5-1 includes port 2-1 and 2-3, whereas the second transmission line 5-2 includes port 2-2 and 24. The port 2-3 is connected to a termination resistor 3, which in turn, is coupled to ground potential. As before, if the device 1' is not terminated properly, signal energy can be reflected back into the directional coupler 1' and degrade its performance (such as return loss).

Now that some context has been provided, it should be noted that some of the issues impacting the design and manufacture of termination devices are related to device size, ease and simplicity of manufacture, power handling capability, bandwidth and impedance matching considerations.

In one approach that has been considered, high power RF terminations 3 can be produced using a thick film process that deposits substantially rectangular resistive patches onto a dielectric layer. When the subsequent termination device 3 is in use, it is typically mounted on a heat sink. The resistive patches are configured to convert the RF energy to thermal energy (i.e., $I^2R$ losses) so that the dielectric layer conducts the heat to the underlying heat sink. The power handling of the RF termination is proportional to the area of the resistive patch. Thus, those skilled in the art will appreciate that higher power handling can be achieved by increasing the size of the termination 3.

This approach, however, has drawbacks. For example, relatively large resistive patches are typically commensurate with relatively large parasitic capacitances that limit the high frequency performance to about 1 GHz. In order to improve the high frequency performance, designers typically employ additional tuning components (i.e., inductance) to substantially eliminate the parasitic capacitance at the resonant frequency. While additional tuning components may be employed to substantially eliminate the parasitic capacitance, the designer must also take into account the fundamental tradeoff between bandwidth and power handling.

In another approach that has been considered, an RF termination element may be implemented using a relatively long lossy transmission line that is disposed on a dielectric layer. Referring to FIG. 3, therefore, a detail schematic diagram of a termination element realized by a lossy transmission line is shown. The characteristic impedance of the transmission line is Zo, which is equal to the system impedance (Zs), which is typically about 50 Ohms. The lossy transmission line 3-1 is configured to have a length (L) so that the wave travels a distance that is substantially equal to two times of the physical line length (2*L). The end of the lossy transmission line can be either connected to ground or left as an open circuit.

In operation, an incident signal wave propagates to the end of the transmission line and then is reflected back toward the signal source. However, as the reflected RF signal propagates toward the signal source, the lossy T-line termination causes the RF energy to be converted into thermal energy ($I^2R$ losses); and thus, the reflected signal decays due to the thermal losses. By properly selecting the length of the lossy transmission line, the reflection is attenuated to a negligible level when it returns to the RF device port (i.e., the signal source or input) because the reflected RF power has been converted to heat. This approach has very good high frequency response and there is no confliction between the bandwidth and power capability.

This approach also has drawbacks: because of practical limitations, the termination depicted in FIG. 3 is best realized using stripline technology. As those skilled in the art will appreciate, a stripline device requires a relatively complicated multilayer structure that includes interlayer vias and the like. Accordingly, the manufacture of a termination device of this type requires a more complicated and expensive process than what is typically employed in a standard thick film process.

To be specific, the lossy device 3 shown in FIG. 3 is typically manufactured using a co-fired ceramic build process that includes four green ceramic dielectric layers. The lossy transmission line 3-1 is typically implemented in two parts; i.e., a circuit trace metallization process prints the transmission line on two respective dielectric layers. The dielectric layers with the trace layers must be stacked-up in the correct order. In other words, each metal trace layer is unique within the stack up and has a unique beginning and a unique end. Moreover, each trace may have a different trace width and or distance to ground because of the electrical RF design requirements. Because two traces are employed to implement lossy line 3-1, vias are required to connect to the layer above to the layer below. As a result, the required via holes must be "punched" into the respective layers and filled with a conductive material. (The lossy device 3 can also be made with a bare minimum of two dielectric layers instead four. In this case, the circuit trace is sandwiched between the two layers, with the outer surfaces of the top and bottom layer including ground metallization. Even so, vias are still required because the center trace must be connected to the exterior of the device, and the top and bottom ground layers must be interconnected). After these steps are completed, the "stack-up" is fired to cure (harden) the green ceramic and conductive material in the vias and trace layers. The exterior surfaces are then metalized with nickel plating. (The plating could also employ silver, gold, tungsten, or conductive non-metallic materials such as graphite).

What is needed therefore is a termination device that offers performance similar to a lossy transmission line while overcoming its drawbacks. For example, a lossy termination device is needed that can be produced using standard thick film processes. As such, a lossy termination device is needed that requires a transmission line that has higher impedance and a smaller line length. What is further needed is a termination device that can be implemented using a microstrip structure rather than a more complicated and expensive stripline structure.

SUMMARY OF THE INVENTION

The present invention addresses the needs described above by providing a termination device that offers performance similar to a lossy transmission line while overcoming its drawbacks. Thus, the present invention is directed toward a lossy termination device that can be produced using standard thick film processes. Moreover, the present invention includes a transmission line that has higher impedance and a smaller line length. As a result, the present invention provides a microstrip structure that can be manufactured using a relatively simple and inexpensive process.

To be specific, the present invention employs a lossy transmission line that features a pair of transmission lines that are strategically terminated. Moreover, the required line length is dramatically reduced and the transmission lines have higher impedance. In practice, these features enable the termination part to be manufactured using standard thick film processes. As a result, the overall cost of the termination device is dramatically reduced. If a designer assumes the same attenuation per unit length, the present invention halves the line length requirement of the device shown in FIG. 3. Because the present invention employs transmission lines having higher impedance, the required linewidth of the present invention is smaller than a lower impedance transmission line. As a result, the size of the termination device is greatly reduced so that the lossy line termination of the present invention can be implemented in a microstrip structure by standard thick film processes. As a result, the termination of the present invention is less complex and much more cost effective that similar lossy terminations.

One aspect of the present invention is directed to an RF termination device for use in a system characterized by a predetermined system impedance. The device includes a substrate having a first major surface and a second major surface, a ground plane being disposed on the second major surface. An input port is disposed on the first major surface. A first meandered transmission line is disposed on the first major surface, the meandered first transmission line having a first characteristic impedance corresponding to a predetermined first transmission line length to provide a predetermined attenuation amount, the first meandered transmission line having a first-first meandered transmission line end coupled to the input port and a second-first meandered transmission line end open circuited. A second meandered transmission line is disposed on the first major surface proximate the first meandered transmission line, the meandered second transmission line having a second characteristic impedance corresponding to a predetermined second transmission line length to provide the predetermined attenuation amount, the second meandered transmission line having a first-second meandered transmission line end coupled to the input port and a second-second meandered transmission line end coupled to the ground plane.

In one embodiment, the device is configured as a microstrip structure.

In one embodiment, the substrate is formed from a ceramic material.

In one version of the embodiment, the ceramic material includes an AlN material.

In one embodiment, the input port is configured to divide an incident RF signal into a first RF signal and a second RF signal, the first RF signal being directed down the first meandered transmission line and the second RF signal being directed down the second meandered transmission line so that the device experiences a predetermined return loss.

In one version of the embodiment, both the first RF signal and the second RF signal traverse each of the first meandered transmission line and the second meandered transmission line twice before recombining at the input port as a residual RF signal.

In one embodiment, the predetermined attenuation amount substantially corresponds to a return loss less that about −30 dB.

In one embodiment, the first characteristic impedance and the second characteristic impedance are substantially equal to twice the predetermined system impedance.

In one embodiment, the predetermined first transmission line length and predetermined second transmission line length are less than or equal to about thirty (30) inches.

In another aspect, the present invention is directed to an RF termination device for use in a system characterized by a predetermined system impedance. The device includes a substrate having a first major surface and a second major surface. A first meandered transmission line is disposed on the first major surface, the meandered first transmission line having a predetermined first transmission line length and a characteristic impedance substantially equal to twice the predetermined system impedance, the first meandered transmission line having a first-first transmission line end portion and a second-first transmission line end portion configured as an open circuit. A second meandered transmission line is disposed on the first major surface adjacent the first meandered transmission line, the meandered second transmission line having a predetermined second transmission line length and a characteristic impedance substantially equal to twice the predetermined system impedance, the second meandered transmission line having a first-second transmission line end portion coupled to the first-first transmission line end portion and a second-second transmission line end portion coupled to a ground plane.

In one embodiment, the device further comprises a ground plane disposed on the second major surface so that the device is configured as a microstrip structure.

In one embodiment, the device further comprises an input port disposed on the first major surface, the input port being coupled to the first-second transmission line end portion and the first-first transmission line end portion.

In one version of the embodiment, the input port is configured to divide an incident RF signal into a first RF signal and a second RF signal, the first RF signal being directed down the first meandered transmission line and the second RF signal being directed down the second meandered transmission line so that the device experiences a predetermined return loss.

In one version of the embodiment, both the first RF signal and the second RF signal traverse each of the first meandered transmission line and the second meandered transmission line twice before recombining at the input port as a residual RF signal.

In one embodiment, the predetermined first transmission line length and the predetermined second transmission line length are a function of a predetermined attenuation amount and the characteristic impedance.

In one embodiment, the substrate is formed from a ceramic material.

In one version of the embodiment, the ceramic material includes an AlN material.

In yet another aspect, the present invention is directed to a method of making an RF termination device for use in a system characterized by a predetermined system impedance, the method includes: providing a substrate having a first major surface and a second major surface; forming a first meandered transmission line on the first major surface, the meandered first transmission line having a first characteristic impedance corresponding to a predetermined first transmission line length to provide a predetermined attenuation amount, the first meandered transmission line having a first-first transmission line end portion and a second-first transmission line end portion configured as an open circuit; and forming a second meandered transmission line on the first major surface, the meandered second transmission line having a second characteristic impedance corresponding to a predetermined second transmission line length to provide the predetermined attenuation amount, the second meandered transmission line having a first-second transmission line end portion coupled to the first-first transmission line end portion and a second-second transmission line end portion coupled to a ground plane.

In one embodiment, the method further includes the step of disposing a ground plane on the second major surface so that the device is configured as a microstrip structure.

In one embodiment, the substrate is formed from a ceramic material.

In one version of the embodiment, the ceramic material includes an AlN material.

In one embodiment, the second meandered transmission line is disposed adjacent and parallel to the first meandered transmission line.

In one embodiment, the method includes the step of forming an input port on the first major surface, the input port being coupled to the first-second transmission line end portion and the first-first transmission line end portion.

In one embodiment, the predetermined first transmission line length and the predetermined second transmission line length are a function of a predetermined attenuation amount and the characteristic impedance.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

FIG. 4 is a schematic diagram of a termination element in accordance with the present invention;

FIG. 5A is a diagrammatic depiction of a trace layout of the termination element depicted in FIG. 4;

FIG. 5B is a detail view of the trace shown in the termination element depicted in FIG. 5A;

DETAILED DESCRIPTION

Figure 1:
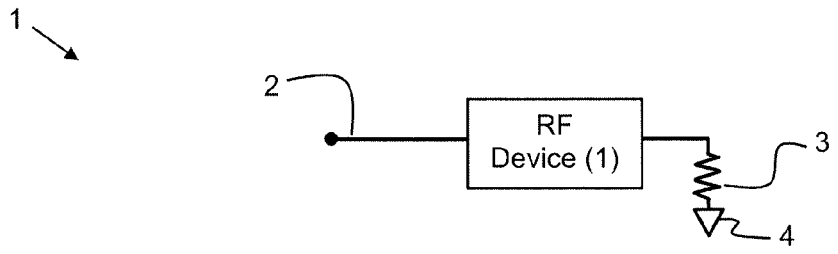
FIG. 1 is a block diagram of an RF device connected to a termination.
Figure 2:
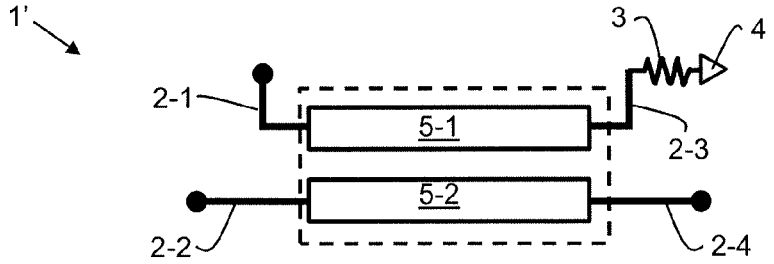
FIG. 2 is a diagrammatic depiction of an RF device connected to a conventional termination element.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the RF termination element of the present invention is shown in FIG. 4, and is designated generally throughout by reference numeral 10.

As embodied herein, and depicted in FIG. 4, a schematic diagram of a termination element 10 in accordance with the present invention is disclosed. The termination device 10 includes two equal length transmission lines 12, 14 that are connected at the input port 16.

Each transmission line 12, 14 features a characteristic impedance Zo that is substantially equal to twice the system impedance Zs (i.e., Zo=2Zs) in order to match the port of the system impedance (Zs). In one embodiment the system impedance Zs is 50 Ohm; thus, the characteristic impedances of the two equal-length transmission lines (12, 14) is substantially equal to 100 Ohm. The end of the transmission line 12 is left open, whereas the end of the transmission line 14 is shorted to ground.

Because the two parallel transmission lines 12, 14 present an impedance that is matched to the system impedance (i.e., Zs=Zo/2), when an RF device initially presents an incident RF signal at the input port 16, there is no reflection back toward the device (see, e.g., RF device 1 at FIG. 1). Instead, the incident RF wave is evenly divided into two RF signals so that half of the RF energy propagates along transmission line 12 while the remaining half of the RF energy propagates down transmission line 14. Each RF signal is converted into thermal energy as it propagates, and it slowly decays due to the thermal losses. Once the RF signals reach the end of their respective transmission lines, both waves are totally reflected due to the boundary condition. Since transmission line 12 is open circuited, the reflected RF signal remains substantially in phase (because the reflection coefficient of an open termination is 1); on the other hand, the reflected signal that propagates down transmission line 14 is substantially 180° out-of-phase (since the reflection coefficient of a short termination is −1). Accordingly, when the reflected waves superimpose at the input 16, they substantially cancel each other out (because the reflected waves are of equal magnitude and 180° degrees out of phase). As a result, the termination device 10 substantially does not direct any reflected energy back into the system (characterized by system impedance Zs). If the afore described cancelation is perfect, the reflected waves propagate across the input 16 and continue their journey along the other line. (If the cancelation is imperfect, the wave will propagate outside the device as reflected energy). When these signals again reach the end their respective lines, they are reflected again so that an additional phase difference of 180° is introduced so that the reflected waves are substantially in-phase. When these reflected signals again superimpose at input port 16, the residual energy exits the device as reflected energy. However, those skilled in the art will appreciate that one-half of an incident RF signal propagates a total distance equal to four times of physical line length L. Accordingly, any superimposed signal that propagates out of the input port 16 is attenuated to a negligible level with a suitable line length (L) so that any desired (low) return loss is readily achievable by the present invention.

Figure 3:
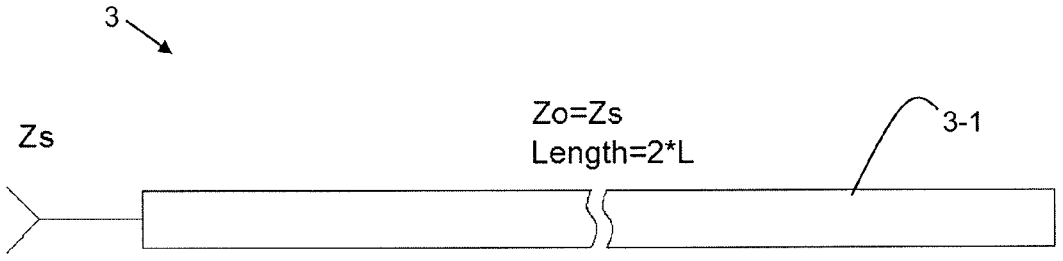
FIG. 3 is a detail schematic diagram of the conventional termination element depicted in FIG. 2.

When one compares the termination element 10 shown in FIG. 4 with the conventional line termination 1' depicted in FIG. 3, the advantages of the present invention become apparent. For example, as noted above, the present invention includes two parallel transmission lines 12, 14 that present an impedance that is matched to the system impedance (i.e., Zs=Zo/2). The transmission line 12 is open circuited and the transmission line 14 is shorted so that each half of an incident RF signal propagates a total distance that is equal to four times of physical line length L. With respect to the conventional design, the characteristic impedance of the transmission line is Zo=Zs and the end of the transmission line is either open or short. An incident RF signal will only travel a distance equal to two times the physical line length. If one assumes that the present invention and the conventional device have the same attenuation per unit length, the line length requirement of the present invention is one-half that of the convention device (FIG. 3). Since the linewidth of a high impedance (2*Zs) transmission line is smaller than the linewidth of a low impedance (Zs) transmission line, the device of FIG. 4 can be realized in a much smaller volume that the conventional device depicted in FIG. 3.

Accordingly, the termination device of the present invention features a termination device that is greatly reduced vis á vis the conventional part depicted in FIG. 3. More importantly, the size reduction described herein allows the "lossy line" termination device 10 (of FIG. 4) to be manufactured as microstrip structure so that standard thick film processes can be employed. For all of the aforementioned reasons, the termination device 10 of the present invention is much more cost effective than the conventional part depicted in FIG. 3.

Referring to FIG. 5A, a diagrammatic depiction of a trace layout for the termination element 10 depicted in FIG. 4 is disclosed. The trace for transmission line 12 is disposed on the left hand side of the substrate 20; again, the end portion of transmission line 12 is open-circuited. The trace for transmission line 14 is disposed on the left hand side of the substrate 20. The transmission line 14 includes a relatively short lead 14-3 that is connected to ground by an edge-wrapped plating 15-1 that provides connectivity to a bottom ground plane 15. Transmission line 12 and transmission line 14 are joined at the termination input 16 at the center of the substrate 18. In one embodiment of the present invention, the traces (12, 14) and the substrate 18 are implemented by a resistive paste to a 60 mil AlN substrate, respectively. Once the resistive paste is applied to the AlN substrate, the structure is fired for curing. In another embodiment, the resistive paste may be implemented by a resistive paste (e.g., TR9200) from Tanaka Kikinzoku Group (TKI) or an equivalent material. The characteristic impedance of all conductive materials can be measured in Ohms/square. (A lossy transmission line can be modeled as a large number of identical segments; each segment being characterized by an impedance measured in Ohms/square. Each segment is characterized by a segment resistance that is a function of the Ohms/square impedance. The overall attenuation provided by the traces is thus a function of the trace length and the characteristic impedance).

Referring to FIG. 5B, a detail view of the trace 14 shown in the termination element 10 depicted in FIG. 5A is disclosed. In order to implement a 100 Ohm microstrip (2*Zs), the traces have about a 9 mil linewidth 14-1 and a 0.7 mil thickness. The characteristic impedance of the conductive material is about 0.1 Ohm/square. To be specific, both of the traces (12, 14) have a 9 mil linewidth and are each about thirty (30) inches long to achieve a −30 dB return loss at 0.5 GHz.

Figure 5C:
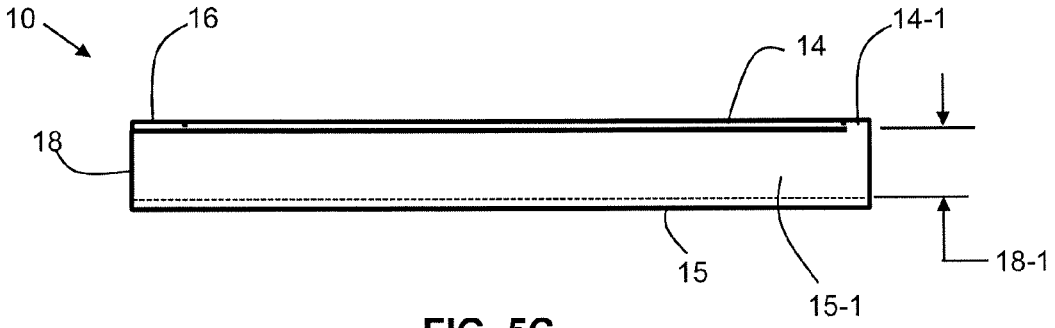
FIG. 5C is a cross-sectional view of the termination element depicted in FIG. 5A.

Turning to FIG. 5C, a cross-sectional view of the termination element 10 depicted in FIG. 5A is disclosed. Again the thickness 18-1 of the AlN substrate is about 60 mil. As noted above, the relatively short lead 14-3 is connected to the ground plane 15 by an edge-wrapped plating 15-1 that provides connectivity between the lead 14-3 and the bottom ground plane 15.

Figure 6A:
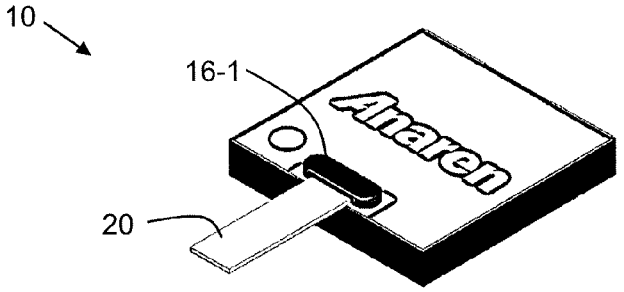
FIG. 6A is an isometric view of a termination element part in accordance with the present invention.
Figure 6B:
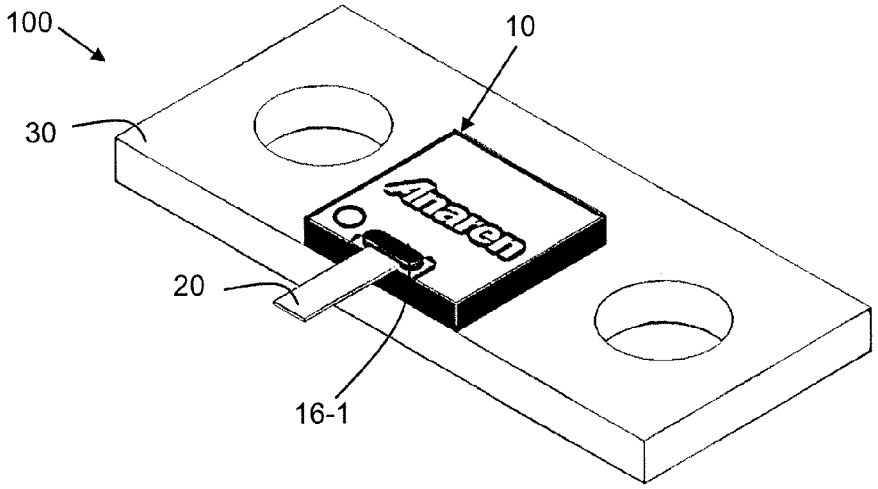
FIG. 6B is an isometric view of the termination element part depicted in FIG. 6A on a flange element.

Referring to FIG. 6A, an isometric view of an RF termination part 10 in accordance with the present invention is disclosed. The encapsulated part 10 includes a lead 20 that is soldered to pad 16-1, which coupled to the input port 16. The termination part 10 has a footprint that is less than about one square inches (1 sq. in.). As shown in FIG. 6B, an RF assembly 100 includes the termination product 10 disposed on a flange 30. The flange 30 is employed as a heat sink. Thus, the $I^2R$ losses described above are conducted through AlN substrate 60 to the heat sink flange 30 and dissipated. As before, the termination device 10 (depicted in FIGS. 5A-6B) features a 100 Ohm characteristic impedance, a 9 mil linewidth, and a transmission line length of about thirty (30) inches to achieve a −30 dB return loss at 0.5 GHz. Those skilled in the art will appreciate that the footprint of the present invention represents a size reduction greater than 50%. Moreover, by using a thicker ceramic substrate than what is employed in the conventional stripline devices, the risk of device cracking is greatly reduced.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. There is no intention to limit the invention to the specific form or forms disclosed, but on the contrary, the intention is to cover all modifications, alternative constructions, and equivalents falling within the spirit and scope of the invention, as defined in the appended claims. It is, therefore, to be understood that the foregoing embodiments are presented by way of example only and that, within the scope of the appended claims and equivalents thereto; inventive embodiments may be practiced otherwise than as specifically described and claimed.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An RF termination device for use in a system characterized by a predetermined system impedance, the device comprising:

a substrate including a first major surface and a second major surface, a ground plane being disposed on the second major surface;

an input port disposed on the first major surface;

a first meandered transmission line disposed on the first major surface, the meandered first transmission line having a first characteristic impedance corresponding to a predetermined first transmission line length to provide a predetermined attenuation amount, the first meandered transmission line having a first-first meandered transmission line end coupled to the input port and a second-first meandered transmission line end open circuited; and a second meandered transmission line disposed on the first major surface proximate the first meandered transmission line, the meandered second transmission line having a second characteristic impedance corresponding to a predetermined second transmission line length to provide the predetermined attenuation amount, the second meandered transmission line having a first-second meandered transmission line end coupled to the input port and a second-second meandered transmission line end coupled to the ground plane.

2. The device of claim 1, wherein the device is configured as a microstrip structure.

3. The device of claim 1, wherein the substrate is formed from a ceramic material.

4. The device of claim 3, wherein the ceramic material includes an AlN material.

5. The device of claim 1, wherein the input port is configured to divide an incident RF signal into a first RF signal and a second RF signal, the first RF signal being directed down the first meandered transmission line and the second RF signal being directed down the second meandered transmission line so that the device experiences a predetermined return loss.

6. The device of claim 5, wherein both the first RF signal and the second RF signal traverse each of the first meandered transmission line and the second meandered transmission line twice before recombining at the input port as a residual RF signal.

7. The device of claim 1, wherein the predetermined attenuation amount substantially corresponds to a return loss less that about −30 dB.

8. The device of claim 1, wherein the first characteristic impedance and the second characteristic impedance are substantially equal to twice the predetermined system impedance.

9. The device of claim 1, wherein the predetermined first transmission line length and predetermined second transmission line length are less than or equal to about thirty (30) inches.

10. An RF termination device for use in a system characterized by a predetermined system impedance, the device comprising:

a substrate including a first major surface and a second major surface;

a first meandered transmission line disposed on the first major surface, the meandered first transmission line having a predetermined first transmission line length and a characteristic impedance substantially equal to twice the predetermined system impedance, the first meandered transmission line having a first-first transmission line end portion and a second-first transmission line end portion configured as an open circuit; and a second meandered transmission line disposed on the first major surface adjacent the first meandered transmission line, the meandered second transmission line having a predetermined second transmission line length and a characteristic impedance substantially equal to twice the predetermined system impedance, the second meandered transmission line having a first-second transmission line end portion coupled to the first-first transmission line end portion and a second-second transmission line end portion coupled to a ground plane.

11. The device of claim 10, wherein the ground plane is disposed on the second major surface so that the device is configured as a microstrip structure.

12. The device of claim 10, further comprising an input port disposed on the first major surface, the input port being coupled to the first-second transmission line end portion and the first-first transmission line end portion.

13. The device of claim 12, wherein the input port is configured to divide an incident RF signal into a first RF signal and a second RF signal, the first RF signal being directed down the first meandered transmission line and the second RF signal being directed down the second meandered transmission line so that the device experiences a predetermined return loss.

14. The device of claim 13, wherein both the first RF signal and the second RF signal traverse each of the first meandered transmission line and the second meandered transmission line twice before recombining at the input port as a residual RF signal.

15. The device of claim 10, wherein the predetermined first transmission line length and the predetermined second transmission line length are a function of a predetermined attenuation amount and the characteristic impedance.

16. The device of claim 10, wherein the substrate is formed from a ceramic material.

17. The device of claim 14, wherein the ceramic material includes an AlN material.

18. A method of making an RF termination device for use in a system characterized by a predetermined system impedance, the method comprising:

providing a substrate having a first major surface and a second major surface;

forming a first meandered transmission line on the first major surface, the meandered first transmission line having a first characteristic impedance corresponding to a predetermined first transmission line length to provide a predetermined attenuation amount, the first meandered transmission line having a first-first transmission line end portion and a second-first transmission line end portion configured as an open circuit; and forming a second meandered transmission line on the first major surface, the meandered second transmission line having a second characteristic impedance corresponding to a predetermined second transmission line length to provide the predetermined attenuation amount, the second meandered transmission line having a first-second transmission line end portion coupled to the first-first transmission line end portion and a second-second transmission line end portion coupled to a ground plane.

19. The method of claim 18, wherein the ground plane is disposed on the second major surface so that the device is configured as a microstrip structure.

20. The method of claim 18, wherein the substrate is formed from a ceramic material.

21. The method of claim 20, wherein the ceramic material includes an AlN material.

22. The method of claim 18, wherein the second meandered transmission line is disposed adjacent and parallel to the first meandered transmission line.

23. The method of claim 18, further comprising the step of forming an input port on the first major surface, the input port being coupled to the first-second transmission line end portion and the first-first transmission line end portion.

24. The method of claim 18, wherein the predetermined first transmission line length and the predetermined second transmission line length are a function of the predetermined attenuation amount and the characteristic impedance.

* * * * *